United States Patent [19]

Doepgen et al.

[11] Patent Number: 5,072,533

[45] Date of Patent: Dec. 17, 1991

[54] SYSTEM FOR ROLLING ADVERTISING POSTERS

[76] Inventors: Heinz Doepgen, Gosperstrasse 18-20, B-4700 Eupen, Belgium; Gerhard, Winkelmann, Brahmsweg 1, D-5014 Kerpen, Fed. Rep. of Germany; Jean Vermeulen, De Roest d'Alkemadelaan 5-59, B-2600 Berchem, Belgium

[21] Appl. No.: 381,657

[22] PCT Filed: Oct. 7, 1988

[86] PCT No.: PCT/BE88/00028

§ 371 Date: Jun. 7, 1989

§ 102(e) Date: Jun. 7, 1989

[87] PCT Pub. No.: WO89/03570

PCT Pub. Date: Apr. 20, 1989

[30] Foreign Application Priority Data

Oct. 7, 1987 [BE] Belgium ..... 8701141
Dec. 21, 1987 [BE] Belgium ..... 8701464

[51] Int. Cl.[5] ..... G09F 11/18

[52] U.S. Cl. ..... 40/518; 40/471; 40/472

[58] Field of Search ..... 40/518, 471, 472, 5, 40/361, 364, 367, 478, 483

[56] References Cited

U.S. PATENT DOCUMENTS

| | | | |
|---|---|---|---|
| 2,167,518 | 7/1939 | Lins | 40/518 |
| 2,549,452 | 4/1951 | Green | 40/518 |
| 3,426,461 | 2/1969 | Miller | 40/471 |
| 3,485,094 | 12/1969 | Simpson | 40/361 X |
| 3,510,973 | 5/1970 | Mazzocco, Sr. | 40/471 |
| 4,090,315 | 5/1978 | Brown, Jr. et al. | 40/518 |

FOREIGN PATENT DOCUMENTS

| | | | |
|---|---|---|---|
| 2514074 | 7/1976 | Fed. Rep. of Germany . | |
| 635277 | 3/1928 | France | 40/518 |
| 1328806 | 4/1963 | France | 40/518 |
| 2205243 | 5/1974 | France . | |
| 374293 | 6/1932 | United Kingdom | 40/518 |

*Primary Examiner*—Kenneth J. Dorner
*Assistant Examiner*—J. Hakomaki
*Attorney, Agent, or Firm*—Herbert Dubno; Yuri Kateshov

[57] ABSTRACT

A supporting assembly including a first and second reel defining a transport path therebetween of a transport band mounted rotatably on the reels. The first roller and a second rollers are bridged by an endless band spanning the rollers and movable in concert with the transport band. The transport band is provided with transverse, parallel clamps which serve to releasably retain a poster.

5 Claims, 2 Drawing Sheets

SYSTEM FOR ROLLING ADVERTISING POSTERS

CROSS REFERENCE TO RELATED APPLICATIONS

This is a National Phase Application of PCT/BE88/00028 filed Oct. 7, 1988 and based, in turn, upon Belgium application Nos. 8701141 of Oct. 7, 1987 and 8701464 of Dec. 21, 1987 under the International Convention.

FIELD OF THE INVENTION

The present invention relates to advertising made up of advertising posters using paper or any other printing support in tape form and arranged in sequence, and relates to an unwinding system for such posters.

BACKGROUND OF THE INVENTION

From French patent FR-A-2 205 243 a system is known with two drums driven by a chain rolling up a flexible polyester, fabric or cloth film. On this film symbols, figures or letters may be stuck, welded or fastened. This system is only useful for small pictures, texts or signals as complete posters, either stuck or fastened, crease or tear during rolling.

From German patent DE-A-2 514 074 an unwinding system for an endless tape is known, on which advertisements, drawings or other articles are attached either by sticking or by fastening, but in this system there is no rolling up.

The horizontal or vertical transport or a tape comprising a series of advertisements or a support for advertisements arranged in sequence, poses the problem of its guidance. The tape rolled onto a reel has to move over two return axes before rolling onto a second reel in order to then return to the first reel.

OBJECTS OF THE INVENTION

It is the object of the present invention to provide a structure avoiding drawbacks of the prior art.

Yet, another object is to provide a system of a perfectly guided transport tape which adheres well to paper.

SUMMARY OF THE INVENTION

These problems of the transport of the tape bearing the advertisements are solved according to the invention by forming the transport tape of polyethylene glycol terephthalate.

The transport tape according to the invention made of polyethylene glycol terephthalate has various advantage. Due to its perfect insulating qualities it has a very great electrostatic adhesion with the advertisements at the same time providing an ideal support for them.

A transport tape of this type is very flexible and very resistant to wear and tearing. It is 100% transparent which is necessary for illuminating the advertisements with neon tubes. Its dimensions are stable under different conditions, i.e. held under a large force at temperatures varying from —20° C. to 100° C., it is completely insensitive to humidity.

According to the invention, the posters of paper or other printing support are loaded onto the transport tape by units without being stuck there, which allows one or another of the advertisements to be easily replaced unlike the present system made up of a band formed of several posters connected to each other.

According to the invention each poster is fixed separately at its four corners onto the transport tape by a self-adhesive and flexible profiled strip in order to allow a slight displacement of the poster on the support caused by rolling up and the guarantee of an automatic return to the original position.

According to the invention, at more or less regular intervals, narrow vertical flaps are provided on the support tape made of the same material as the support tape and secured to the tape in such a way as to provide a recess for the insertion of the lateral edge of the poster, in order to keep it in position and allow it to move slightly horizontally to the left and to the right owing to the rolling up.

The unrolling system according to the invention is also characterized in that it comprises a guiding system for the transport band comprising an endless tape stretched around return axes and set in motion by the transport band bearing the posters.

The invention also relates to an arrangement of reels in an unrolling system for double-sided advertising posters. This arrangement is characterized in that the reels on one side are arranged in line in relation to the reels on the other side.

BRIEF DESCRIPTION OF THE DRAWING

These and other features, objects, and advantages will become more readily apparent from the following description, reference being made to the following drawing in which.

SPECIFIC DESCRIPTION

Figure 1:
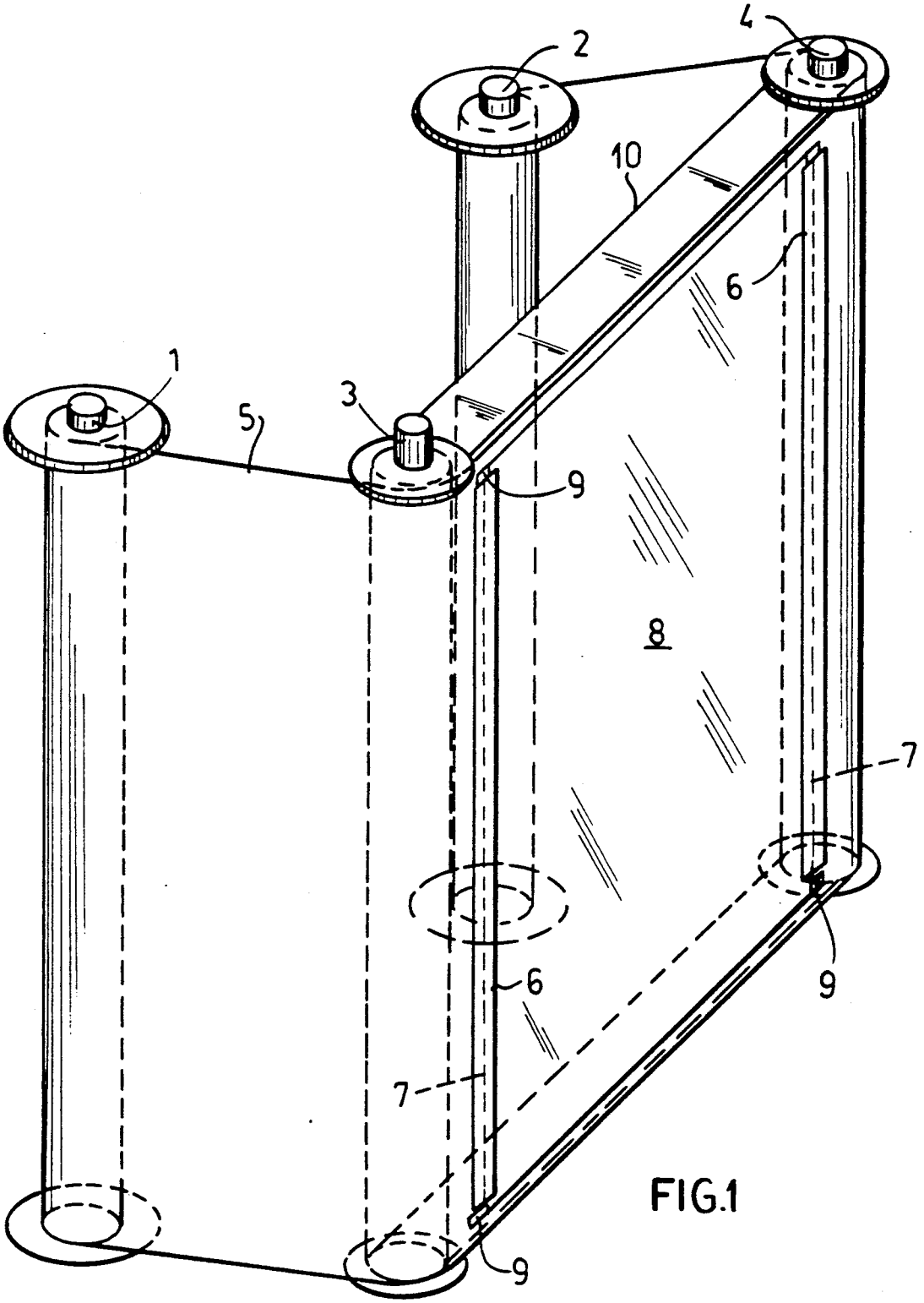
FIG. 1 a perspective view of an advertising monolith produced according to the invention, and FIG. 2 a perspective view of a two-sided advertising monolith according to the invention.

The advertising monolith shown in FIG. 1 comprises two reels 1, 2 and two return axes 3, 4. On these reels 1, 2 a transport tape 5 made of polyethylene glycol terephthalate is rolled backwards and forwards. The drive of the reels (not shown) is stepwise by motors directly coupled to the reels and provided with an optical and magnetic positioning device. The motors are controlled by computer with an interchangeable program.

Flaps 6 made of the same material as the tape are secured vertically onto the transport tape 5 by any suitable means at more or less regular intervals depending on the width of the advertisements.

This attachment is achieved in such a way that it leaves a recess 7 along the flap or the tongue for inserting the lateral edge of the poster 8. The advertisement is held in place in these lateral recesses while being able to be slightly displaced horizontally to the left and to the right at the time of unwinding.

The posters 8 on the transport tape are secured at their four corners by self-adhesive and flexible band elements 9, in such a way as to allow the poster to be slightly displaced on rolling and to guarantee an automatic return to position.

Only one poster 8 is shown on the support tape 5 for the reasons of clarity of the drawing.

In order to guide the advertising poster 8 properly, an endless tape 10 is stretched around the return axes 3, 4. This tape is also produced according to the invention from polyethylene glycol terephthalate. This endless type functions as a support and rest when the poster 8 is placed on the transport tape 5. It prevents any displacement outside the unwinding axis by ensuring adequately parallel transport.

For the sake of clarity of the drawings, FIG. 1 shows an advertising unit formed with the return axes 3, 4 of which are somewhat spaced from the reels 1, 2 but in actual fact the distance is smaller in order to reduce bulkiness.

This bulk will, however, be significant if a two-sided unwinding system is produced. For this purpose, the reels are arranged according to the invention as shown in FIG. 2.

Figure 2:
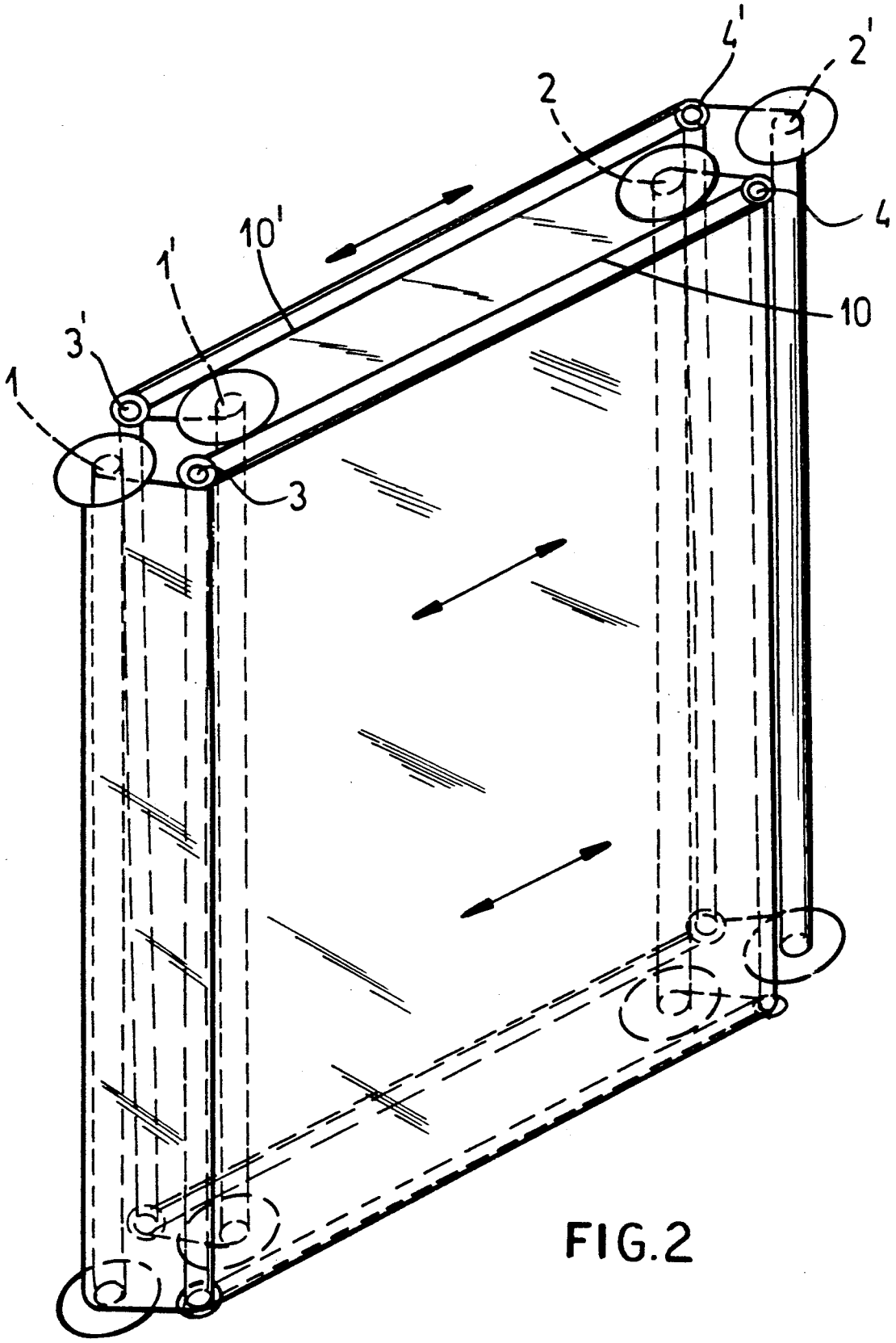

As can be seen in the drawings in FIG. 2, the arrangement is such that the reels 1, 2 on one side are arranged in line in relation to the reels 1', 2' on the other side. In this way greatly reduced bulk is obtained which from several points of view is advantageous for the environment either as far as aesthetics or visibility are concerned.

Besides this two-sided advertising monolith in FIG. 2 it is, of course, possible to produce a monolith with several linked unwinding systems in whatever shape is suitable, such as square, rectangular, round, or triangular, allowing advertising to be displayed on each side.

We claim:

1. A support assembly for displaying advertising posters, said assembly comprising:

a first reel and a second reel rotatable about respective unwinding axes and defining a transport path therebetween;

a transport band of polyethylene glycol terephthalate mounted rotatably on said first and second reels and bridging said reels, so that said transport band is rolled upon said reels and displaced along said path;

a first roller and a second roller rotatable about respective vertical return axes parallel to one another and spaced from one another along said transport path;

a flat planar endless support band spanned between said rollers for supporting said transport band, said transport band passing around said rollers and being in contact with said endless band located adjacent to said transport band between said rollers, so that said endless band is driven upon rolling of said transport band; and means on said transport band for yieldably mounting a poster on said transport band, said endless band lying against said transport band, so that said transport band with said poster mounted thereon is supported by said endless band between said first and second rollers.

2. The support assembly defined in claim 1 wherein said means on said transport band for mounting said poster includes flexible strip element of polyethylene glycol terephthalate, engaging corners of said poster.

3. The support assembly defined in claim 2 wherein said strip elements are provided on said transport band at intervals corresponding to a width of said poster.

4. The support assembly defined in claim 1, further comprising a third reel and a fourth reel aligned with said first and second reels and a further transport band of polyethylene glycol terephthalate spanning said third and fourth reels and carrying a respective poster, so that said posters can be displayed simultaneously on opposite surfaces of said assembly.

5. The support assembly defined in claim 1 wherein said assembly is formed with a plurality of surfaces adopted to receive said posters simultaneously.

* * * * *